United States Patent [19]

Weathers et al.

[11] Patent Number: 4,882,818

[45] Date of Patent: Nov. 28, 1989

[54] CARPET SHEARING APPARATUS

[76] Inventors: John B. Weathers, 544 Dawnville Rd., NE., Dalton, Ga. 30720; Paul B. Mitchell, Jr., 2003 Ravenwood Dr., Collinsville, Ill. 62234; Coy L. Sampson, 800 S. Hamilton St., Dalton, Ga. 30720; Charles B. Hubbs, P.O. Box 1886, Dalton, Ga. 30722

[21] Appl. No.: 267,806

[22] Filed: Nov. 4, 1988

[51] Int. Cl.[4] ..... D06C 13/00

[52] U.S. Cl. ..... 26/15 R

[58] Field of Search ..... 26/15 R, 15 L, 15, 16, 26/18

[56] References Cited

U.S. PATENT DOCUMENTS

| | | | |
|---|---|---|---|
| 2,387,579 | 10/1945 | Griffie et al. | 26/15 R |
| 3,769,666 | 11/1973 | Kaufman | 26/15 R |
| 4,649,606 | 3/1987 | Fay | 26/15 R |

*Primary Examiner*—Werner H. Schroeder
*Assistant Examiner*—Jodi A. Tokar

[57] ABSTRACT

A carpet shearing machine for modular carpet which includes a moveable table which is provided with means for holding the modular carpet. A carpet shear is positioned on a moveable frame which is adjustable to a predetermined distance above the moveable table. The moveable frame may be pivoted and raised above the moveable table such that the modular carpet on the table may be passed beneath and through the shear and thereafter the shear is raised to permit the moveable table to return to its original position.

6 Claims, 4 Drawing Sheets

CARPET SHEARING APPARATUS

BACKGROUND OF THE INVENTION

The present invention relates to a carpet shearing machine for modular carpet. In the processing of pile carpet it is desirable to shear the pile to obtain a uniform height for the carpet.

Previously, carpet was produced and processed in rolls which were sheared by continuously passing the rolled carpet through the shears. The rolled material was passed through the shear in one direction and the equipment was not capable of handling small modular pieces of carpet such as 12×12 or 24×24 inch modules.

A method of processing modular carpet was to place the carpet material on a stationary table and to pass the shear over the carpet. This equipment did not adequately trim and clean the pile carpet. Additionally, the equipment was difficult to use and maintain.

SUMMARY OF THE INVENTION

Modular pile carpet, i.e. carpet which is not prepared and processed in rolls and is typically of 12 inch by 12 inch or 24 inch by 24 inch squares is becoming more popular. The present invention relates to a carpet shearing machine for shearing this modular pile carpet. The shearing machine of the present invention can accommodate various sizes of modular pile carpeting.

Additionally, the shearing machine of the present invention may be readily adjusted to permit the shearing of different height pile carpeting.

Further, the shearing machine of the present invention permits a single operator to process the modular carpeting and is easy to operate and maintain.

It is a specific object of the present invention to provide a carpet shearing machine which can accommodate various sizes of modular carpet and which will permit the carpet to be passed through the shear and thereafter the shear is raised to permit the carpet to return to its original position for removal from the machine. Various further and more specific purposes, features and advantages will be come apparent from the detailed description given below and taken in connection with the accompanying drawings which form part of this specification and illustrates by way of example, the preferred embodiment of the device of the present invention.

DESCRIPTION OF THE DRAWINGS

In the following description and in the claims, items will be identified by specific names for convenience, but such names are intended to be as generic in their application to similar items as the art will permit. Like reference characters denote like parts in the several figures of the drawings, in which:

DESCRIPTION OF THE PREFERRED EMBODIMENTS

Figure 1:
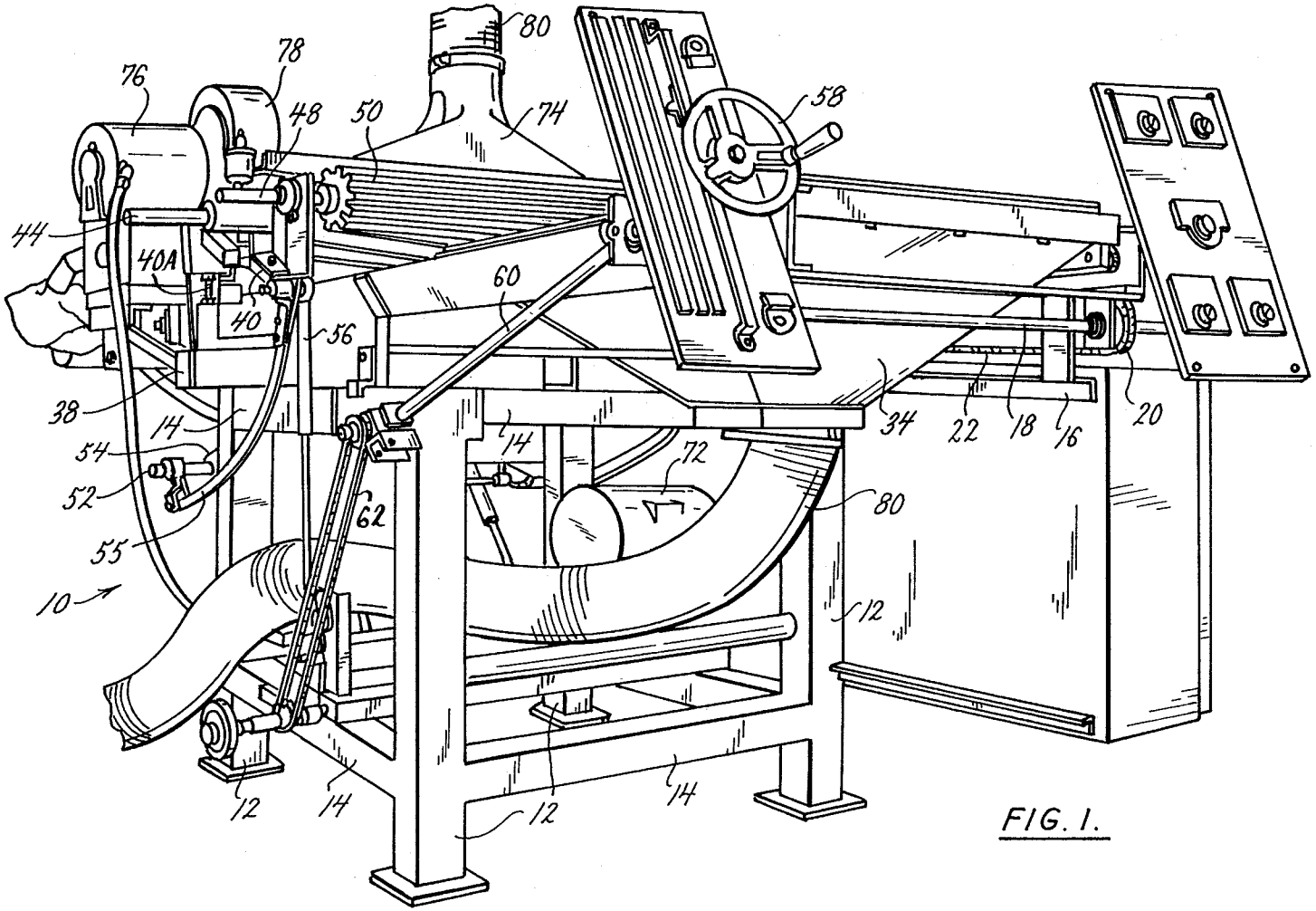
FIG. 1 is a front view of the carpet shearing apparatus of the present invention.
Figure 2:
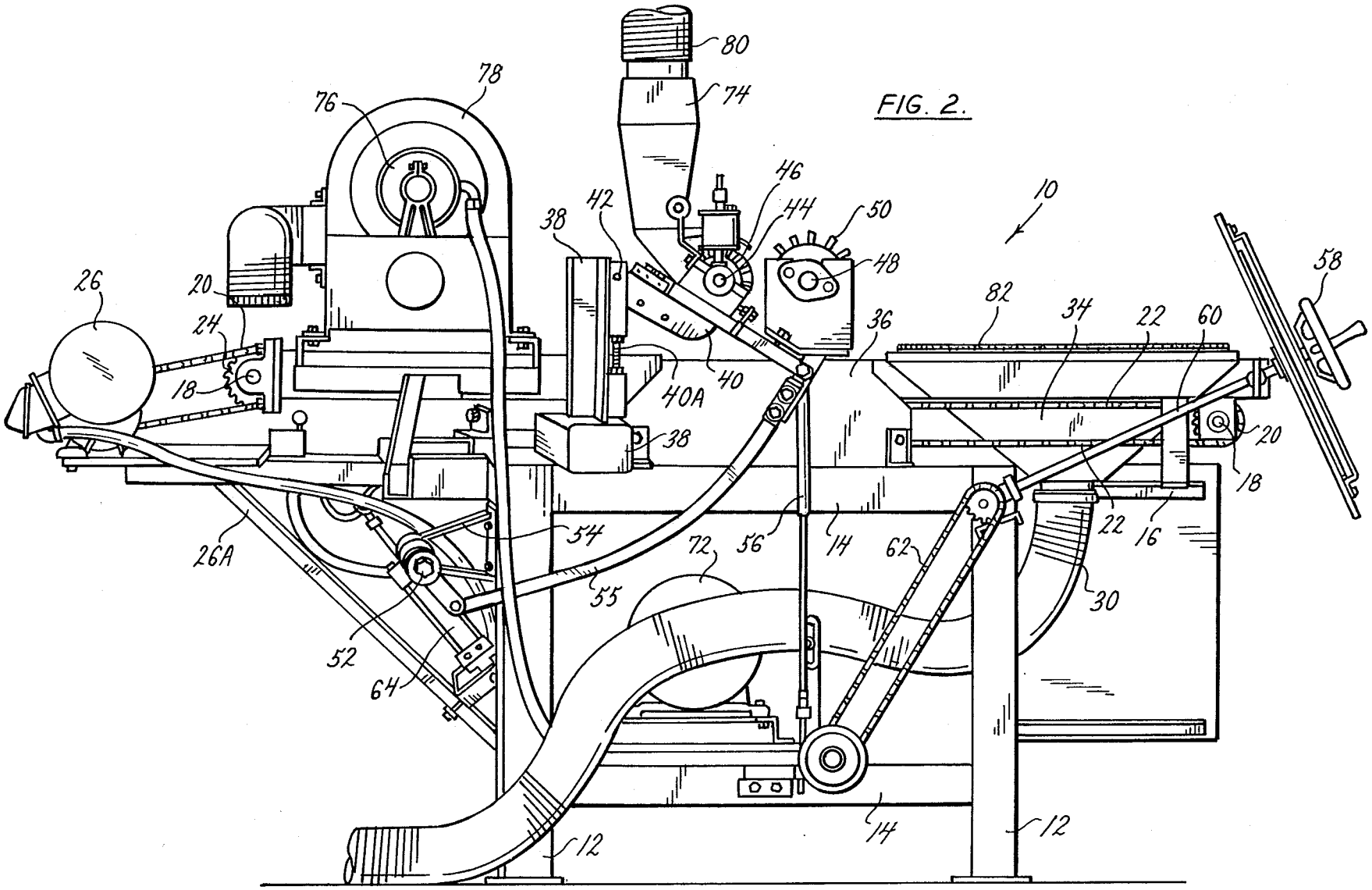
FIG. 2 is a side view of the carpet shearing apparatus of FIG. 1.
Figure 3:
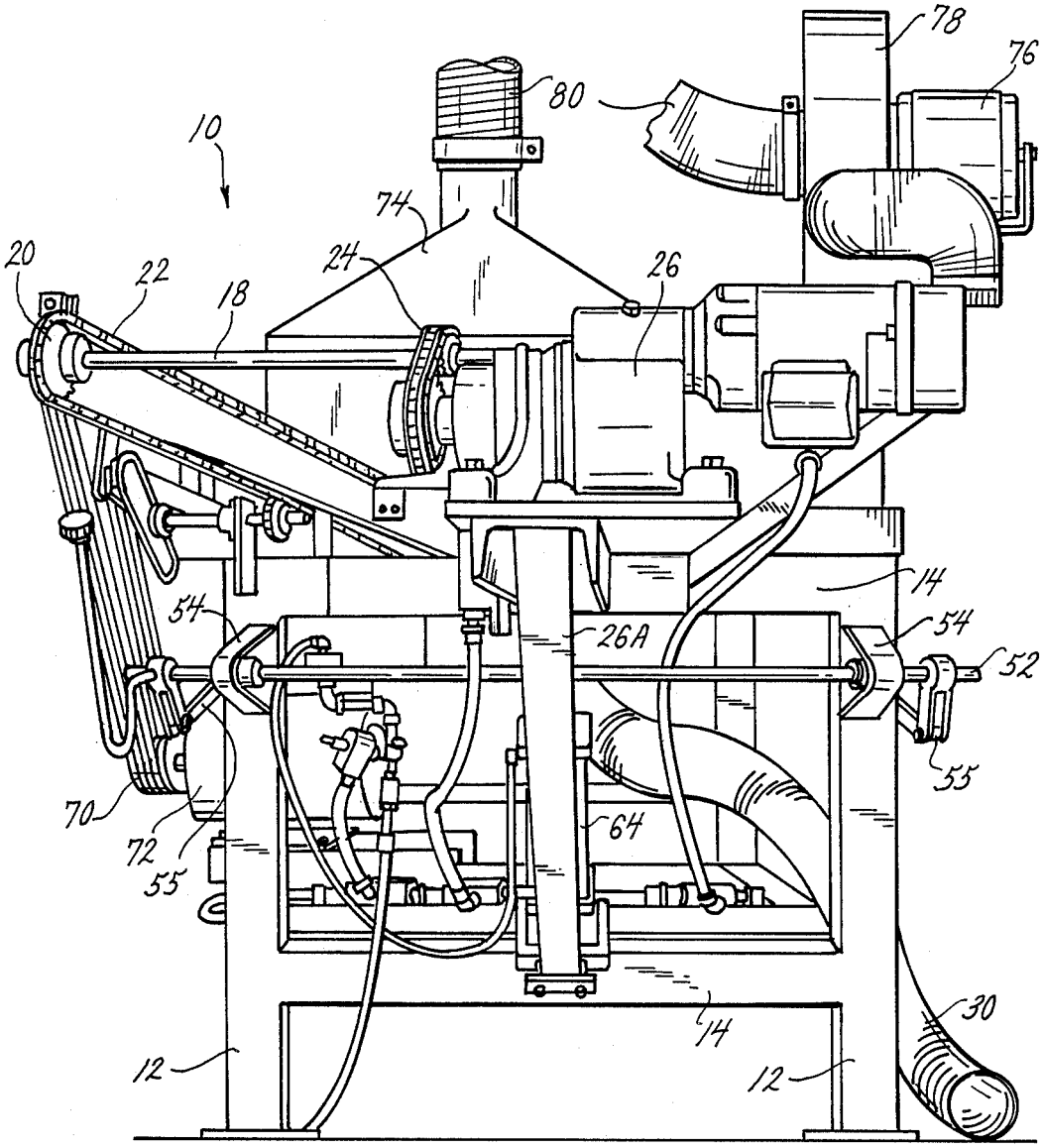
FIG. 3 is a rear view of the carpet shearing apparatus of FIG. 1.
Figure 4:
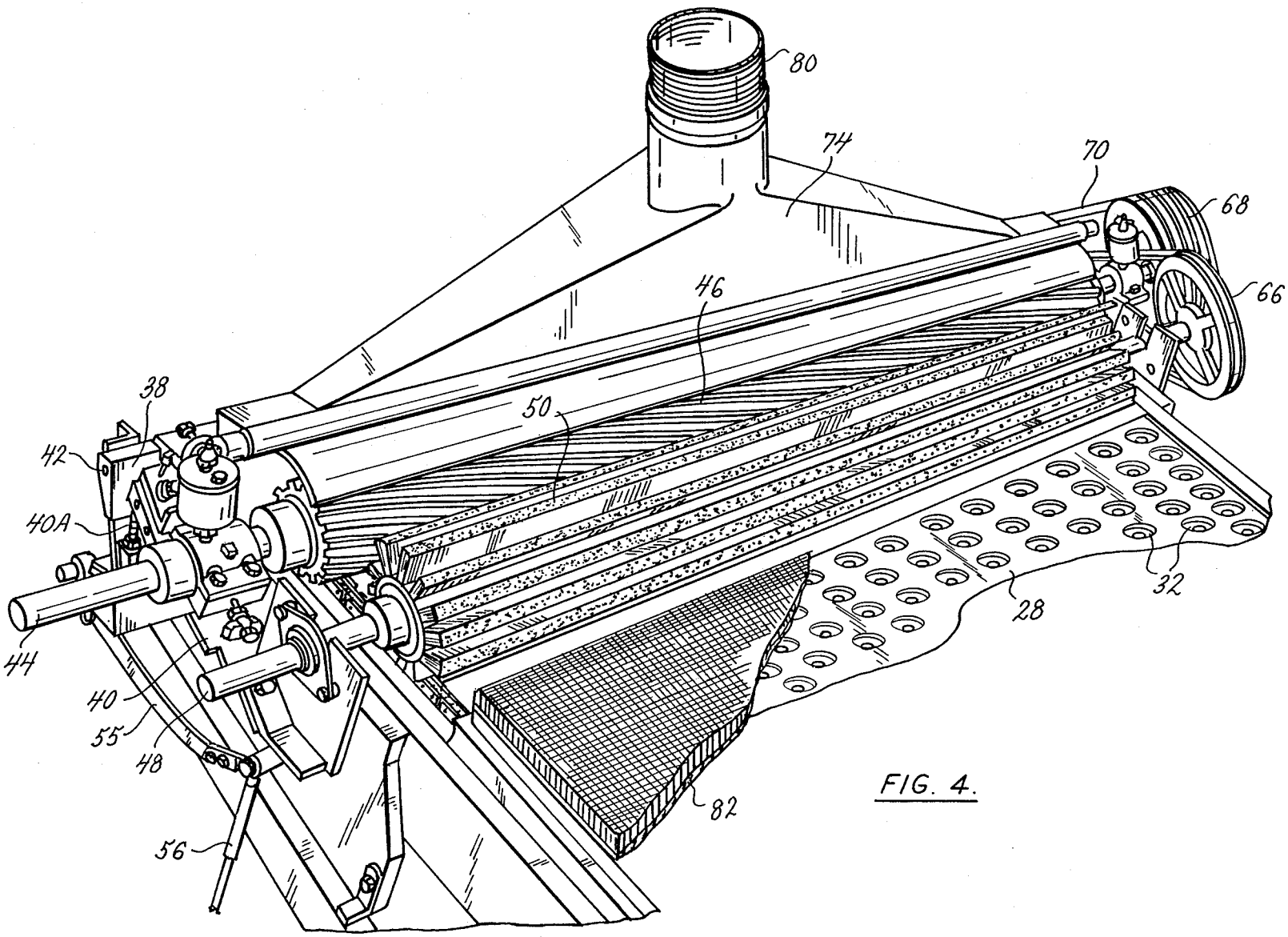
FIG. 4 is a partial sectional view of the shear and brush mechanism of the apparatus of FIG. 1.

Referring to the drawings and in particular to FIGS. 1, 2, 3 and 4, the apparatus of the present invention consists of a frame member 10 having legs 12 with are provided with suitable cross-braces 14. Attached to the cross-braces 14 at each end of the frame member 10 is a table guide arm 16. Each pair of table guide arms 16 are provided with shafts 18 which contain sprockets 20 for accommodating a drive chain 22 on each side of the frame. The shaft 18 at one end of the frame member 10 has connected thereto a drive sprocket 24 which is connected to a suitable drive motor 26. The motor 26 is connected to the frame 10 by suitable bracing and mounting 26A. A table 28 having a surface 30 with plurality of openings 32 therein is positioned between the table guide arms 16. The table 28 is connected on each side to the drive chain's 22 which serves to move the table from the front to the rear of the frame member 10. A suction or vacuum device (not shown) is attached by the hose 30 to the underside of the table 28 through the duct 34 such that the suction or negative air pressure may be established through the openings 32 in the table 28. The drive motor 26 is reversible such that the table 28 can be moved forward and backward by the drive chains 22. A limit switch (not shown) is provided on the frame and is engagable by the table 28 as it moves from the front of the machine to the rear of the machine. This switch is connected to the motor 26 for reversing the motor when engaged.

Sheet metal sides 36 are connected by suitable means to the cross-braces 14 to protect an operator from the drive chains 22. (Note that in FIG. 2 part of the sheet metal side 36 is not shown to provide a better view of the drive chains 22.)

East side of the frame member 10 is provided with a pivotable arm mounting bracket 38. A pivotable arm 40 is connected to the pivotable arms mounting bracket 38 by suitable means such as a pin 42. The pivotable arm mounting bracket 38 is provided with an adjustment bolt 40A for raising and lowering the position of the pin 42 on said bracket.

Mounted on the pivotable arm 40 by suitable means is a shaft 44 which contains the shear 46. If desired a shaft 48 for a brush 50 for aligning the pile on the carpet may be connected to the pivotable arm 40 in front of the shear 46. A shaft 52 is attached to the legs 12 by mounting brackets 54. Each of the pivotable arms 40 are connected by means of linkage members 55 to the shaft 52. Additionally, connected to the pivotable arm 40 at the linkage member 55 is an arm or stop 56. The stop 56 may be raised or lowered by means of the adjustment wheel 58 which is connected through the shaft 60 and sprocket mechanism 62. An air cylinder 64 is mounted on the frame 10 and is connected to the shaft 52 such that when the air cylinder 64 is in its normal position, the pivotable arms 40 are at the height established by the adjustment 40A and stops 56 and the shear 46 and brushes 50 are positioned a predetermined distance above the table 28. When the air cylinder 46 is activated the shaft 52 is turned which through the linkage members 55 causes the pivotable arms 40 to raise. The air cylinder 46 in activated by the table 28 engaging the limit switch as previously discussed.

The shaft 48 is provided with a drive pulley 66 and the shaft 44 is provided with a drive pulley 68. The pulleys 66 and 68 are connected by means of belts 70 to the drive motor and pulley 72. This arrangement of the belts 70 permits the shafts 44 and 48 to be raised and lowered by the pivotable arms 40 without interruption or affecting the rotation of the shears 46 and brush 50.

A suction flume 74 is mounted on the pivotable arm 40 just above the nip area of the shear 46 with the carpet. A motor 76 and impeller 78 are connected by conduit 80 (partly shown) to the suction flume 74 for removing any fiber material removed from the carpet by the shear 46.

In the operation of the equipment, the carpeting 82 to be sheared is placed on the table 28. The suction device is activated which will cause the air pressure through the openings 32 in the table 28 to hold the carpeting 82 in place. The drive motor and pulley 72 is activated causing the brush 50 and shear 46 to be rotated. The table 28 is then moved by the drive chain 22 from its first or load position toward the shear 46. As the carpet 82 passes beneath the shear 46, the pile is sheared with the sheared pieces being removed through the suction flume 74. After the table 28 has passed beneath the shear 46 it engages the limit switch at its second position. This limit switch serves to activate the air cylinder 64, raising the pivotable arm 40 and reversing the drive motor 26 and drive chains 22 to return the table 28 to its original position. When the table 28 reaches its original position a second limit switch (not shown) is engaged which deactivates the air cylinder 64, lowering the pivotable arm 40 to the stops 56. The second limit switch also permits the drive motor 26 to again be reversed for subsequently moving the table 28.

While the invention has been described and illustrated with respect to a certain preferred example, it will be understood by those skilled in the art after understanding the principle of the invention, that various changes and modifications may be made without departing from the spirit and scope of the invention.

What is claimed is:

1. A machine for shearing modular pile carpet comprising a frame having a table thereon which is movable between a first position and a second position, means for holding modular carpet on said table, shear means on said frame positioned a predetermined distance above said table whereby the carpet is sheared as the table moves from the first position to the second position, and said shear means including means for raising said shear when said table is moved from the second position to the first position.

2. The machine of claim 1 wherein said table is provided within a plurality of openings, suction means attached to said table whereby suction air pressure through said openings holds the modular carpet on said table.

3. The machine of claim 1 wherein said shear means comprises a pivotable arm mounted on said frame, a shear mounted in said pivotable arm and an air cylinder connected to said pivotable arm whereby when said air cylinder is in its normal position said shear is in the position a predetermined distance above said table and when said air cylinder is activated the pivotable arm is moved upward to raise said shear.

4. The machine of claim 1 including adjustment means connected to said shear means for adjusting the predetermined distance between said shear and said table.

5. The machine of claim 3 including vacuum means connected to said pivotable arm above said shear for removing shaved pile material.

6. The machine of claim 3 wherein said table is provided with a plurality of openings, suction means attached to said table whereby suction air pressure through said openigns hold the modular carpet on said table.

* * * * *